US010077175B2

(12) United States Patent
Lu et al.

(10) Patent No.: US 10,077,175 B2
(45) Date of Patent: Sep. 18, 2018

(54) LOAD-ADAPTIVE HOISTING MECHANISM

(71) Applicant: Northeastern University, Shenyang, Liaoning Province (CN)

(72) Inventors: Zhiguo Lu, Shenyang (CN); Ji Zou, Shenyang (CN); Tian Tian, Shenyang (CN); Bairen Feng, Shenyang (CN); Zuotao Liu, Shenyang (CN)

(73) Assignee: Northeastern University, Shenyang, Liaoning Province (CN)

( * ) Notice: Subject to any disclaimer, the term of this patent is extended or adjusted under 35 U.S.C. 154(b) by 308 days.

(21) Appl. No.: 15/025,390

(22) PCT Filed: Mar. 31, 2015

(86) PCT No.: PCT/CN2015/075435
§ 371 (c)(1),
(2) Date: Mar. 28, 2016

(87) PCT Pub. No.: WO2016/000469
PCT Pub. Date: Jan. 7, 2016

(65) Prior Publication Data

US 2016/0236919 A1 Aug. 18, 2016

(30) Foreign Application Priority Data

Jun. 30, 2014 (CN) ..... 2014 1 0306366

(51) Int. Cl.
*B66D 1/40* (2006.01)
*B66D 1/28* (2006.01)
(Continued)

(52) U.S. Cl.
CPC ..... *B66D 1/40* (2013.01); *B66D 1/26* (2013.01); *B66D 1/28* (2013.01); *B66D 1/48* (2013.01)

(58) Field of Classification Search
CPC ... B66D 1/40; B66D 1/26; B66D 1/28; B66D 1/48; B66C 13/08
See application file for complete search history.

(56) References Cited

U.S. PATENT DOCUMENTS 3,443,698 A * 5/1969 Lopez ..... B66C 13/08 191/12 R
3,608,384 A * 9/1971 Hardin ..... B66C 13/08 294/81.4
(Continued)

FOREIGN PATENT DOCUMENTS

CN 2153531 Y 1/1994
CN 2835198 Y 11/2006
(Continued)

*Primary Examiner* — Michael E Gallion
(74) *Attorney, Agent, or Firm* — Muncy, Geissler, Olds & Lowe, P.C.

(57) ABSTRACT

Provided is a load-adaptive hoisting mechanism, including a bracket and roofs, wherein the roofs are arranged above the bracket, upright columns are arranged between the bracket and the roofs, through holes corresponding to the upright columns are formed in the roofs, the upright columns are arranged in the through holes, and the lower ends of the upright columns are connected with the bracket; springs sleeve the upright columns between the bracket and the roofs; roof pulleys arranged on the side surfaces of the roofs, bracket pulleys arranged on the side surfaces of the bracket, and the side surfaces of the roofs corresponding to the side surfaces of the bracket; a truncated conical roller arranged in the center above the bracket.

11 Claims, 5 Drawing Sheets

(51) Int. Cl.
*B66D 1/26* (2006.01)
*B66D 1/48* (2006.01)

(56) References Cited

U.S. PATENT DOCUMENTS

| | | | | | |
|---|---|---|---|---|---|
| 5,324,007 | A * | 6/1994 | Freneix | B66D 1/54 | 254/285 |
| 5,678,805 | A * | 10/1997 | Moser | A63B 47/021 | 242/388.8 |
| 2008/0121601 | A1* | 5/2008 | Ehrenleitner | B66C 1/20 | 212/76 |
| 2010/0051767 | A1* | 3/2010 | Erel | B66C 23/02 | 248/205.1 |
| 2010/0224843 | A1* | 9/2010 | Christensen | B63B 35/816 | 254/271 |
| 2014/0175353 | A1* | 6/2014 | Hoffend, Jr. | B66D 1/26 | 254/376 |
| 2015/0274269 | A1* | 10/2015 | Toce | B63C 3/06 | 405/3 |

FOREIGN PATENT DOCUMENTS

| | | | |
|---|---|---|---|
| CN | 200981795 | Y | 11/2007 |
| CN | 103818839 | A | 5/2014 |
| CN | 104085809 | A | 10/2014 |
| EP | 2 199 470 | B1 | 6/2013 |
| SU | 711235 | A1 | 1/1980 |

* cited by examiner

LOAD-ADAPTIVE HOISTING MECHANISM

BACKGROUND OF THE INVENTION

1. Field of the Invention

The present invention belongs to the technical field of engineering machinery, and particularly relates to a load-adaptive hoisting mechanism.

2. The Prior Arts

The hoisting mechanism is an important operating part of a lot of engineering machinery. In order to meet high load demands, the hoisting speed of the hoisting mechanism commonly used in conventional hoists, freight elevators and other machinery sometimes needs to be reduced. However, in that case, even if the actual load is changed to be lighter, the hoisting speed cannot be correspondingly increased. In order to meet requirements for both speed and torque, according to conventional methods, usually the motor power is increased, but an adaptive adjusting mechanism for speed and torque is lacked. In order to solve the problem of adjusting hoisting speed and hoisting force, a continuously variable transmission mechanism or a servo motor is adopted in a commonly used method. However, the conventional continuously variable transmission mechanism adopts the complex structure and usually uses a large hydraulic system in a large size as a power source, and the servo motor also requires electronic control and other aided mechanisms for a speed adjustment process, so that maintenance and repair are difficult and the cost is high.

The decelerating mechanism commonly used in the conventional robotic joint and tension-compression apparatus has a constant transmission ratio and the output speed cannot be flexibly adjusted, so that the using range is limited. Robot hands' grasping motion driven by the common hoisting mechanism encounters two opposite problems: the first one: if the grasping speed is high, the target is difficult to grasp tightly due to the constant hoisting force, and therefore the target can slip off; in contrast, if the grasping speed becomes lower, the increased hoisting force can enable the target to be tightly grasped, however the efficiency is reduced.

Currently in the mechanical field, the situation that a transmission mechanism automatically adjusts the output force according to the loads can be realized usually by electrification auxiliary control; the structure is complex, the reliability is poor and applicability is limited, so that very few purely mechanical automatically load-adaptive transmission mechanisms exist in the market.

SUMMARY OF THE INVENTION

In order to solve the problems existing in the prior art, the present invention provides a load-adaptive hoisting mechanism with mechanical intelligence to automatically adapt the weight of the loads and adjust hoisting speed, hoisting force and transmission ratio.

In order to achieve the purpose, the load-adaptive hoisting mechanism adopts the following technical scheme: a load-adaptive hoisting mechanism, includes a bracket and roofs, wherein the roofs are arranged above the bracket, upright columns are arranged between the bracket and the roofs, through holes corresponding to the upright columns are formed in the roofs, the columns are arranged in the through holes, and the lower ends of the upright columns are connected with the bracket; first springs sleeving the upright columns between the bracket and the roofs; roof pulleys arranged on the side surfaces of the roofs, bracket pulleys arranged on the side surfaces of the bracket, wherein the side surfaces of the roods correspond to the side surfaces of the bracket; a roller is arranged in the center above the bracket and being a truncated conical type, wherein the lower end of the roller is the end with smaller diameter, and the roller is connected to a power input shaft of the hoisting mechanism; the upper end of the roller is provided with tensioning cables, one ends of the tensioning cables are fixed to the upper part of the roller, and the other ends are connected to loads sequentially through the roof pulleys and the bracket pulleys.

Four upright columns are symmetrically arranged on two sides of the roller, and the corresponding bracket and the roofs both adopt the symmetrical structure.

Two roof pulleys and two bracket pulleys are arranged.

Two upright columns are arranged on the same side of the bracket, and the corresponding roof adopts the unilateral structure.

One roof pulley and one bracket pulley are arranged.

A fixing frame is arranged above the roofs, the upper end of each upright column passes through the through holes in the roof and is connected to the fixing frame; and a roller shaft is arranged in the center of the larger-diameter end of the roller and is arranged on the fixing frame through a bearing.

The load-adaptive hoisting mechanism disclosed by the present invention uses a motor as the power source.

A load-adaptive hoisting mechanism for transmitting torque power converts the unidirectional movement of the tensioning cables of the hoisting mechanism into circular movement, and torque power is further directly output, so that the output torque can be automatically adjusted according to the loads; the load-adaptive hoisting mechanism includes the bracket and the roofs, wherein the roofs are arranged above the bracket, the upright columns are arranged between the bracket and the roofs, the through holes corresponding to the upright columns are formed in the roofs, the upright columns are arranged in the through holes, and the lower ends of the upright columns are connected with the bracket; first springs sleeving the upright columns between the bracket and the roofs; each of the roofs is provided with two roof pulleys; a roller is arranged in the center above the bracket, being a truncated conical type, and fixedly arranged on the power input shaft in a sleeving manner, wherein the power input shaft is arranged on the bracket via a bearing; transmission wheels arranged at the lower part of each side surface on the bracket corresponding to the roof pulleys; tensioning cables arranged between the transmission wheel and the roller, wherein the tensioning cables in form of a closed ring wind around the two roof pulleys; a cable tensioning mechanism arranged on the tensioning cables between a cable sending side of the roller and a cable winding side of the transmission wheel when the mechanism works.

The cable tensioning mechanism includes a cable binding reel and a cable pushing reel, wherein the cable binding reel is fixedly arranged on the bracket, and the cable pushing reel is provided with a second spring; the cable binding reel and the cable pushing reel are respectively arranged on two sides of the tensioning cables; and the second spring is a thrust spring and is arranged on the opposite side against the tensioning cables.

Four upright columns are symmetrically arranged on two sides of the roller; two roofs, two roof pulleys, two tensioning cables, two transmission wheels and two cable tensioning mechanisms are respectively and symmetrically arranged on two sides of the bracket; the inner side of each transmission wheel is coaxially provided with a small bevel gear; the lower part of the bracket is provided with a power output shaft on which a large bevel gear is mounted in a sleeving manner, and the large bevel gear is meshed with two small bevel gears respectively.

The load-adaptive hoisting mechanism disclosed by the present invention has the beneficial effects that the load-adaptive hoisting mechanism is simple and reliable in structure, high in generality, and low in requirement for power, the hoisting force and the hoisting speed can be automatically adjusted according to the weight of the loads, and the springs between the bracket and the roofs play a role of buffer for the vibration of the loads.

DETAILED DESCRIPTION OF THE PREFERRED EMBODIMENT

Figure 1:
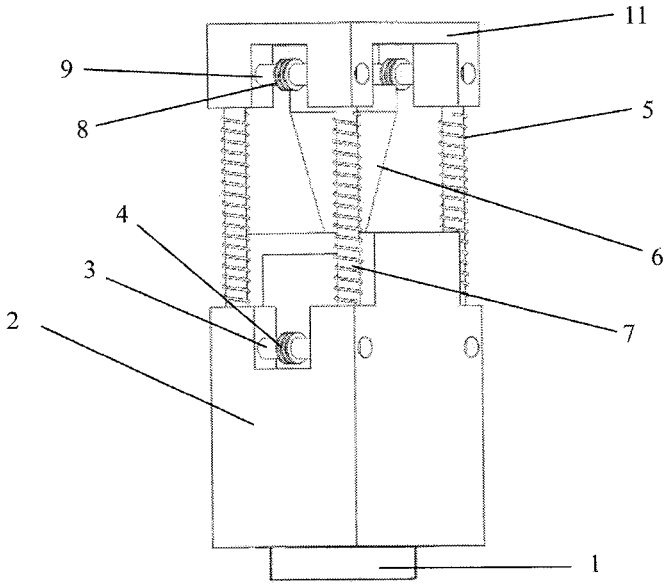
FIG. 1 is a schematic structural view of the first embodiment of the load-adaptive hoisting mechanism disclosed by the present invention.
Figure 2:
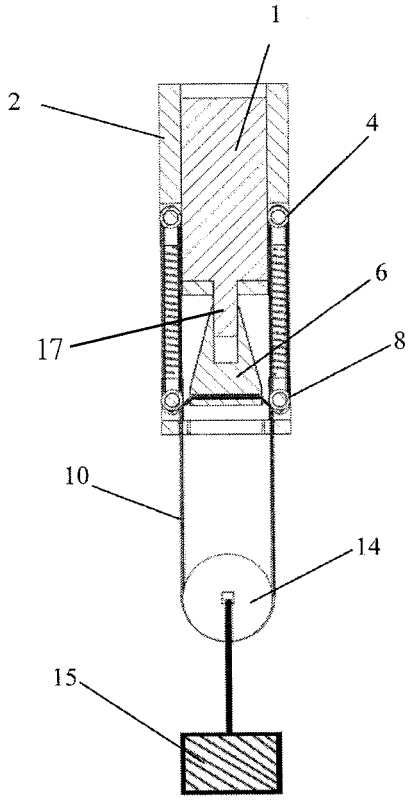
FIG. 2 is a schematic structural view of the load-adaptive hoisting mechanism with loads of FIG. 1 in operation.

The load-adaptive hoisting mechanism disclosed by the present invention is further described in details below in conjunction with the accompanying drawings and embodiments:

First Embodiment: as shown in FIG. 1 and FIG. 2, the load-adaptive hoisting mechanism disclosed by the present invention, includes a bracket 2 and roofs 11, wherein the roofs 11 are arranged above the bracket 2; four upright columns 7 are arranged between the bracket 2 and the roofs 11, which all adopt the symmetrical structure; four through holes corresponding to the upright columns 7 are formed in the roofs 11, so that the upright columns 7 are arranged in the through holes, and the lower ends of the upright columns 7 are connected with the bracket 2; first springs 5 sleeve the upright columns 7 between the bracket 2 and the roofs 11; roof pulleys 8 are arranged on the side surfaces of the roofs 11, bracket pulleys 4 are arranged on the side surfaces of the bracket 2, and the side surfaces of the roofs 11 correspond to the side surfaces of the bracket 2; the roof pulleys 8 are arranged on the roofs 11 through roof cross shafts 9, and the bracket pulleys 4 are arranged on the bracket 2 through bracket cross shafts 3; a truncated conical roller 6 is arranged in the center above the bracket 2, and the lower end of the roller is the end with smaller diameter and is connected to the shaft of a motor 1; the upper part of the roller 6 is connected with one end of each of two tensioning cables 10 respectively via two symmetrical cable connecting pins 13, and the other end of each tensioning cable 10 respectively and sequentially passes through the roof pulleys 8 and bracket pulleys 4 on two sides; one tensioning cable winds around a load-bearing pulley 14 and is connected with the other tensioning cable together. The pulley shaft of the load-bearing pulley 14 is connected to a weight 15.

Before the operation of the load-adaptive hoisting mechanism disclosed by the first embodiment, the hoisting mechanism disclosed by the present invention needs to be inverted first, and the bracket 2 is arranged on a firm load-bearing part. When the motor 1 is started, the motor enables the roller 6 to rotate and wind the tensioning cables 10, and the tensioning cables 10 pull upward the load-bearing pulley 14 through the roof pulleys 8 and the bracket pulleys 4 and further pull the weight 15. In the process, the loads enable the distance between the roof pulleys 8 and the bracket pulleys 4 to be compressed to a certain extent through the tensioning cables 10; the heavier the weight of the loads, the greater the compression is, and the smaller the diameter of the roller 6 aligned with the roof pulleys 8 is; since the output torque of the motor 1 is constant, the output force of the hoisting mechanism is greater, the hoisting speed is slower, and the working condition becomes more stable. Conversely, when the weight of the loads is lighter, the distance between the roof pulleys 8 and the bracket pulleys 4 is compressed less, the diameter of the roller 6 aligned with the roof pulleys 8 is larger, the output force of the hoisting mechanism is smaller, but the hoisting speed is higher. Mechanical intelligence of the hoisting mechanism disclosed by the first embodiment can make the hoisting mechanism to be applied more flexibly for a variety of machinery.

Figure 3:
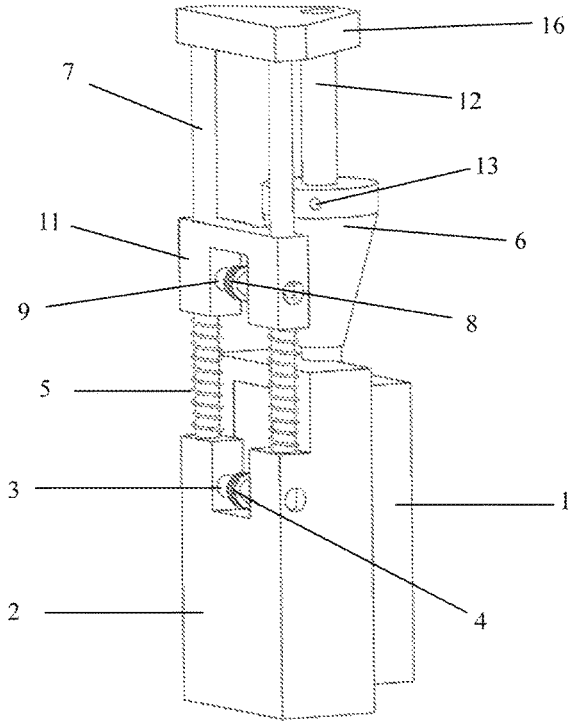
FIG. 3 is a schematic structural view of the second embodiment of the load-adaptive hoisting mechanism disclosed by the present invention.
Figure 4:
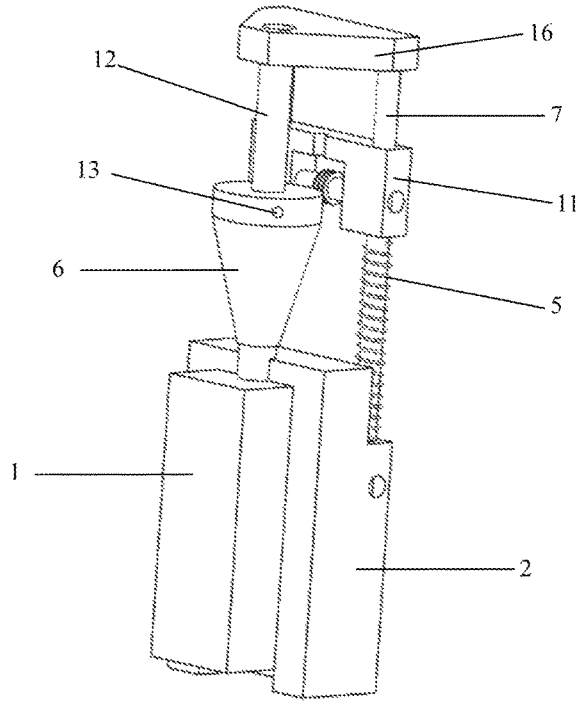
FIG. 4 is a schematic structural view of the rear portion in FIG. 3.
Figure 5:
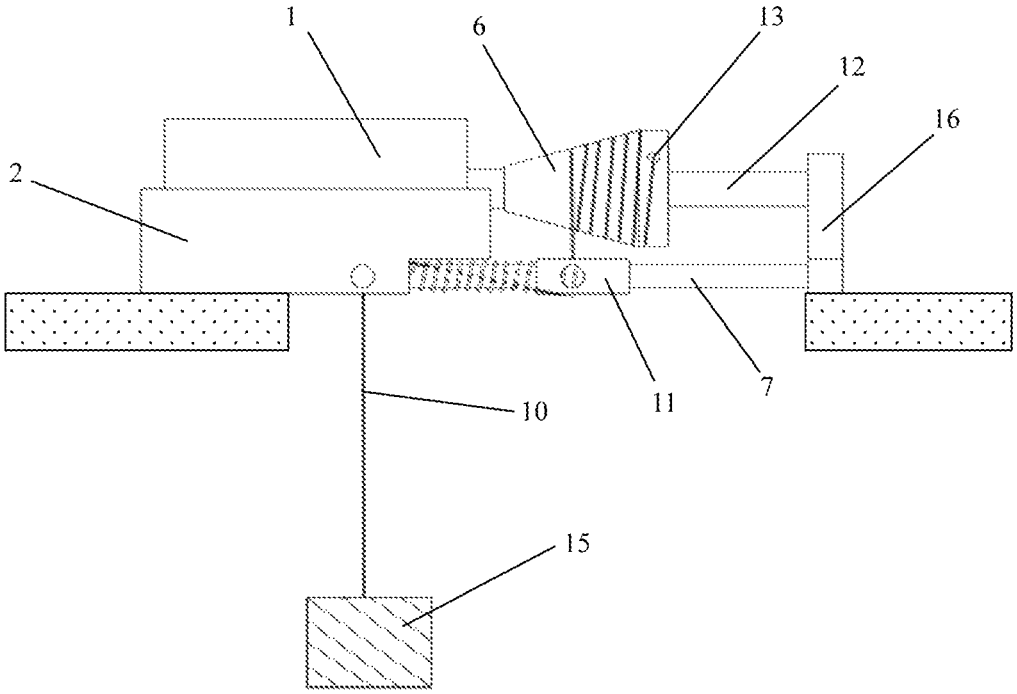
FIG. 5 is a schematic structural view of the load-adaptive hoisting mechanism with loads of FIG. 3 in operation.

Second Embodiment: as shown in FIG. 3 to FIG. 5, the load-adaptive hoisting mechanism disclosed by the present invention, includes a bracket 2 and roofs 11, wherein the roofs 11 are arranged above the bracket 2; two upright columns 7 are arranged between the bracket 2 and the roofs 11; two through holes corresponding to the upright columns 7 are formed in the roofs 11, so that the columns 7 are arranged in the through holes; the upper end of each upright column 7 is provided with a fixing frame 16, and the lower end of each upright column 7 is connected with the bracket 2; first springs 5 sleeve the upright columns 7 between the bracket 2 and the roofs 11; the roof pulleys 8 are arranged on the side surfaces of the roofs 11, the bracket pulleys 4 are arranged on the side surfaces of the bracket 2, and the side surfaces of the roofs 11 correspond to the side surfaces of the bracket 2; the roof pulleys 8 are arranged on the roofs through the roof cross shafts 9, and the bracket pulleys 4 are arranged on the bracket through the bracket cross shafts 3; a truncated conical roller 6 is arranged in the center above the bracket 2, and the lower end of the roller is the end with smaller diameter and is connected to the shaft of a motor 1; the upper part of the roller 6 is connected with one end of a tensioning cable 10 through a cable connecting pin 13, and the other end of the tensioning cable 10 is sequentially connected to the roof pulleys 8 and bracket pulleys 4, and finally connected to the weight 15. A roller shaft 12 is arranged in the center of the larger-diameter end of the roller 6, and the upper end of the roller shaft 12 is arranged on a fixing frame 16. According to the second embodiment, the fixing frame 16 is used for fastening the roller 6 and the upright columns 7. In the first embodiment, the two symmetrical roof pulleys 8 are arranged so that neither roller 6 nor the upright columns 7 are subject to any horizontal moment, and support through the fixing frame 16 is not needed.

Before the operation of the load-adaptive hoisting mechanism disclosed by the second embodiment, the hoisting mechanism is horizontally placed first, and the bracket 2 and fixing frame 16 are fixed to the firm load-bearing part. When the motor 1 is started, the motor enables the roller 6 to rotate and wind the tensioning cables 10, and the tensioning cables 10 pull upward the weight 15 through the roof pulleys 8 and the bracket pulleys 4. In the process, the loads make the distance between the roofs 11 and the bracket 2 to be compressed via the tensioning cables 10; the heavier the weight of the loads, the greater the compression is, and the smaller the diameter of the roller 6 aligned with the roof pulleys 8 is; because the output torque of the motor 1 is constant, the output force of the hoisting mechanism is greater, the hoisting speed is lower, and the working condition becomes more stable. Conversely, when the load weight is light, the distance between the roof pulleys 8 and the bracket pulleys 4 is compressed less, the diameter of the roller 6 aligned with the roof pulleys 8 is larger, the output force of the hoisting mechanism is smaller, but the hoisting speed is higher. The load-adaptive hoisting mechanism disclosed by the second embodiment is mainly applied to, but not limited to, lifting mechanisms; due to the unique mechanical intelligence, the load-adaptive hoisting mechanism can make balance between efficiency and hoisting force.

Figure 6:
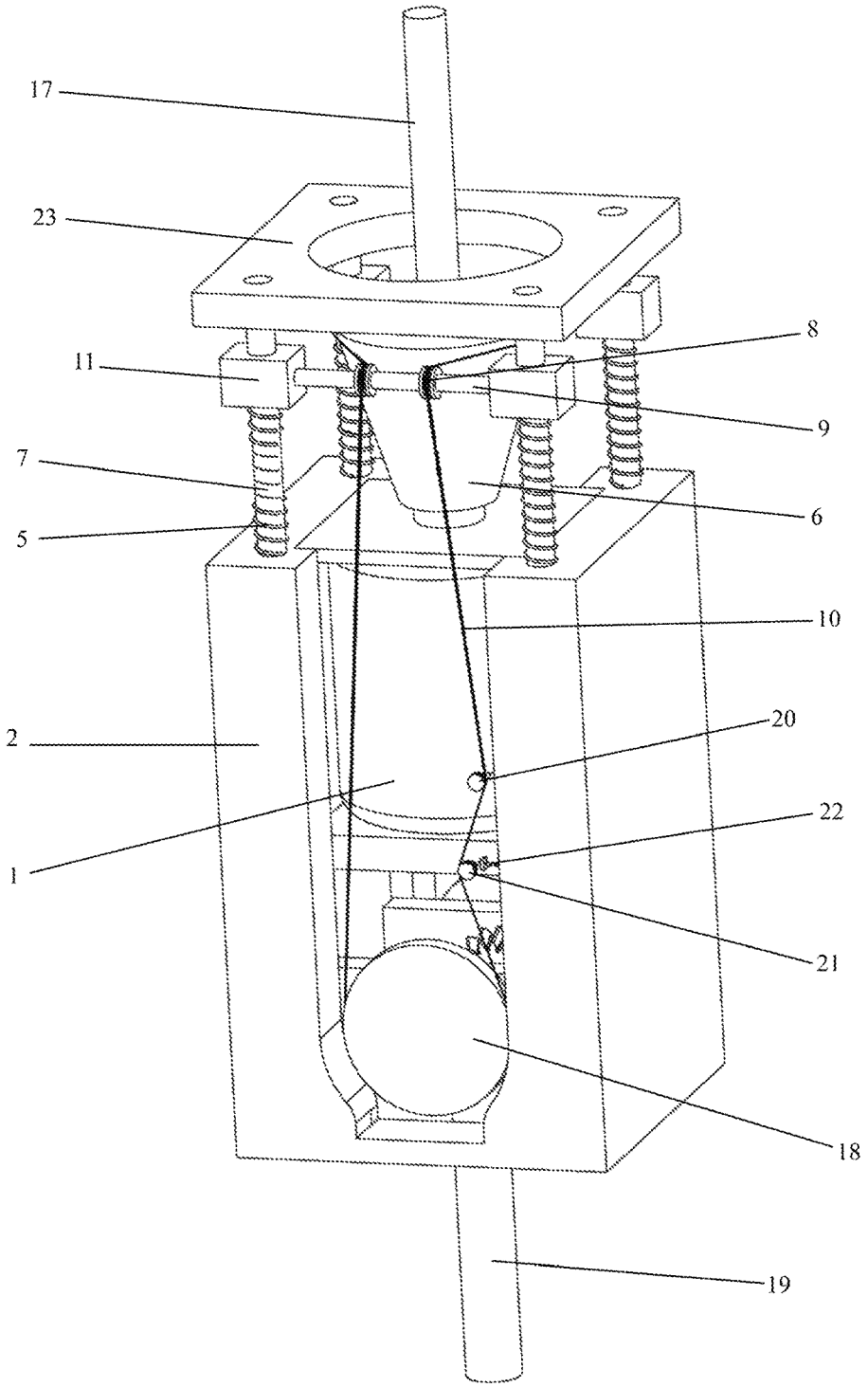
FIG. 6 is a stereogram of the third embodiment of the load-adaptive hoisting mechanism disclosed by the present invention.
Figure 7:
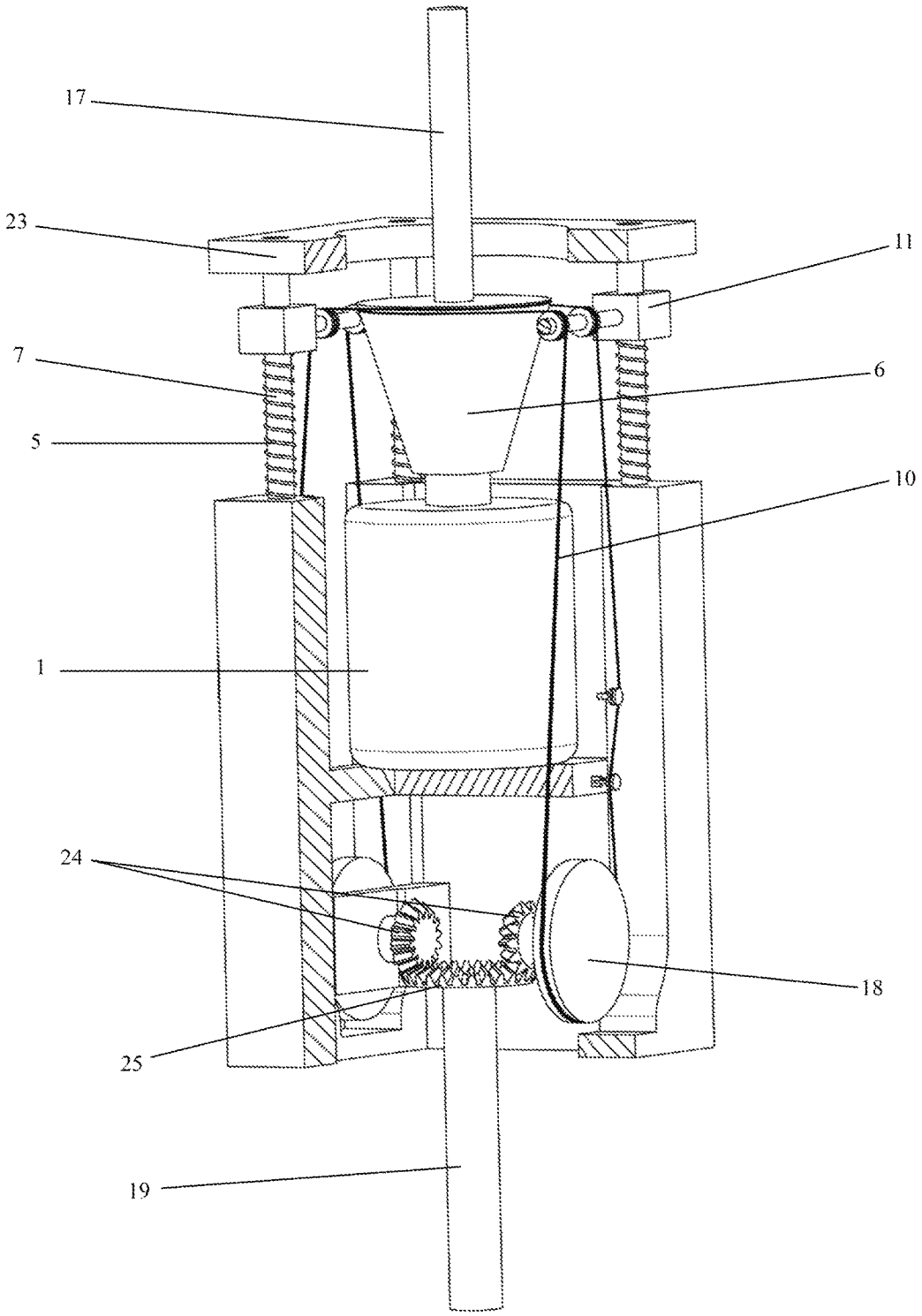
FIG. 7 is a partial section view of FIG. 6, wherein: 1—motor, 2—bracket, 3—bracket cross shaft, 4—bracket pulley, 5—first spring, 6—roller, 7—upright column, 8—roof pulley, 9—roof cross shaft, 10—tensioning cable, 11—roof, 12—roller shaft, 13—cable connecting pin, 14—load-bearing pulley, 15—weight, 16—fixing frame, 17—power input shaft, 18—transmission wheel, 19—power output shaft, 20—cable binding reel, 21—cable pushing reel, 22—second spring, 23—fixing plate, 24—small bevel gear, 25—large bevel gear.

Third Embodiment: as shown in FIG. 6 and FIG. 7, a load-adaptive hoisting mechanism for power transmission, is similar to first embodiment and second embodiment in the structure by mainly includes: a bracket 2, upright columns 7, a roller 6 and roofs 11, wherein the roofs 11 are arranged above the bracket 2; upright columns 7 are arranged between the bracket 2 and the roofs 11; through holes corresponding to the upright columns 7 are formed in the roofs 11, and the columns 7 are arranged in the through holes; the lower ends of the upright columns 7 are connected with the bracket 2; first springs 5 sleeve the upright columns 7 between the bracket 2 and the roofs 11; each of the roofs 11 is provided with a roof pulley horizontal shaft 9 which is provided with two roof pulleys 8; a truncated conical roller 6 is arranged in the center above the bracket 2, and fixedly mounted on a power input shaft 17 in a sleeving manner. However, application occasions are different from those of the load-adaptive hoisting mechanism disclosed by the present invention, so structure differences exist: transmission wheels 18 are arranged at the lower part of each side on the bracket 2 corresponding to the roof pulleys 8 and can be used for power output; in the third embodiment, four upright columns 7, two roofs 11, two transmission wheels 18 and two cable tensioning mechanisms are symmetrically arranged on two sides of the bracket 1; the upper end of each upright column 7 is provided with a fixing plate 23 for fixing the corresponding upright column 7; the inner side of each transmission wheel 18 is coaxially provided with a small bevel gear 24; the lower part of the bracket 2 is provided with a large bevel gear 25 and a power output shaft 19, wherein the large bevel gear 25 is fixedly mounted on the power output shaft 19 which is arranged on the bracket through a shaft in a sleeving manner. The large bevel gear 25 is meshed with two small bevel gears 24 respectively, so that the power of the transmission wheels 18 on two sides can be output. Another difference from the load-adaptive hoisting mechanism disclosed by the present invention is that tensioning cables 10 sequentially wind around the roller 6, one roof pulley 8, the transmission wheels 18 and the other roof pulley 8 to form a closed loop. In order to maintain good touching for the tensioning cables 10 with the roller 6 and transmission wheels 18 and provide sufficient friction, one cable tensioning mechanism shall be arranged on the loose side of each tensioning cable 10, namely between one side sending the tensioning cables 10 of the roller 6 and one side winding the tensioning cables 10 of each transmission wheel 18; in FIG. 6, the roller 6 winds each tensioning cable 10 from the left side and sends the tensioning cable out from the right side, so each cable tensioning mechanism is arranged on each cable on the right side on the bracket 1; each cable tensioning mechanism includes a cable binding reel 20 and a cable pushing reel 21, wherein the cable binding reel 20 is fixedly arranged on the bracket, and the cable pushing reel 21 is provided with a second spring 22 which is a thrust spring; the cable binding reel 20 is arranged on the inner sides of the tensioning cables, and the cable pushing reel 21 is arranged on the outer sides of the tensioning cables, so as to push the tensioning cables 10 inwards, and keep the tensioning cables 10 tensioned during the operation process.

Before the operation of the load-adaptive hoisting mechanism disclosed by present invention, the power input shaft 17 needs to be connected to a power source, and the power output shaft 19 needs to be connected to a load mechanism. In the third embodiment, in order to reduce the size, the motor 1 is used as a power source and arranged in the fixing frame 2, and the shaft of the motor 1 is directly connected to the lower end of the power input shaft 17.

After the motor 1 is started, the motor 1 drives the roller 6 to rotate, and the roller 6 drives the two tensioning cables 10 and further drives the two transmission wheels 18 to rotate; the two transmission wheels 18 drive the two small bevel gears 24 and finally drive the large bevel gear 25 to rotate, and also transmit force to the load mechanism through the output shaft 19; when the loads becomes heavier, the tension applied to the tensioning cables 10 will be increased, so that the sliding top frame 11 is subject to tension in the direction toward the transmission wheels 18, the first springs 5 on the upright columns 7 are compressed, and the touching positions of the tensioning cables 10 on the roller 6 move down; because the roller 6 is in a truncated conical shape, the diameter of the lower part of the roller 6 is smaller than that of the upper part, under the condition of constant input power of the motor 1, if the transmission ratio is increased, the rotational speed of the power output shaft 19 becomes smaller, but the output torque becomes larger. When the loads are lighter, the tension applied to the tensioning cables 10 is reduced, the first springs 5 enable the roofs 11 to rise, then the roof pulleys 8 thus rise, and further the touching positions of the tensioning cables 10 on the roller 6 also move up; under the condition of constant input power of the motor 1, if the transmission ratio is decreased, the rotational speed of the power output shaft 19 is increased, and the output torque becomes smaller. During the operation, the adjustment of the transmission ratio is changed solely on the basis of the weight of the loads. The device has mechanical intelligence, and an external control mechanism does not need to be arranged additionally, so that the cost is reduced, and the work efficiency and the work adaptability are improved.

What is claimed is:

1. A load-adaptive hoisting mechanism, comprising: a bracket and roofs, wherein the roofs are arranged above the bracket, upright columns are arranged between the bracket and the roofs, through holes corresponding to the upright columns are formed in the roofs, the upright columns are arranged in the through holes, and the lower ends of the upright columns are connected to the bracket; first springs sleeving the upright columns between the bracket and the roofs; roof pulleys arranged on the side surfaces of the roofs, bracket pulleys arranged on the side surfaces of the bracket, wherein the side surfaces of the roofs correspond to the side surfaces of the bracket; a roller arranged in the center above the bracket and being a truncated conical type, wherein the lower end of the roller is the end with smaller diameter, and is connected to a power input shaft of the hoisting mechanism; the upper part of the roller is provided with tensioning cables, one ends of the tensioning cables are fixed to the upper part of the roller, and the other ends are connected to loads sequentially through the roof pulleys and the bracket pulleys.

2. The load-adaptive hoisting mechanism of claim 1, wherein four columns are symmetrically arranged on two sides of the roller, and the corresponding bracket and the roofs both adopt symmetrical structures.

3. The load-adaptive hoisting mechanism of claim 2, wherein two roof pulleys and two bracket pulleys are arranged.

4. The load-adaptive hoisting mechanism of claim 1, wherein two upright columns are arranged on the same side of the bracket, and the corresponding roof adopts the unilateral structure.

5. The load-adaptive hoisting mechanism of claim 4, wherein one roof pulley and one bracket pulley are arranged.

6. The load-adaptive hoisting mechanism of claim 4, wherein a fixing frame is arranged above the roofs, and the upper ends of the upright columns penetrate through the through holes in the roofs and are connected with the fixing frame; and the center of the larger-diameter end of the roller is provided with a roller shaft which is arranged on the fixing frame via a bearing.

7. The load-adaptive hoisting mechanism of claim 1, wherein the load-adaptive hoisting mechanism adopts a motor as a power source.

8. A load-adaptive hoisting mechanism, used for transmitting torque power, comprising: a bracket and roofs, wherein the roofs are arranged above the bracket, upright columns are arranged between the bracket and the roofs, through holes corresponding to the upright columns are formed in the roofs, the upright columns are arranged in the through holes, and the lower ends of the upright columns are connected with the bracket; first springs sleeving the upright columns between the bracket and the roofs; two roof pulleys arranged on the roofs; a roller is arranged in the center above the bracket, being a truncated conical type, and fixedly mounted on the power input shaft in a sleeving manner, wherein the power input shaft is arranged on the bracket via a bearing; transmission wheels arranged at the lower part of one side on the bracket corresponding to the roof pulleys; tensioning cables arranged between the transmission wheels and the roller, wherein the tensioning cables in the form of a closed ring wind around the two roof pulleys; a cable tensioning mechanism arranged on the tensioning cables between the cable sending side of the roller and the cable winding sides of the transmission wheels when the mechanism works.

9. The load-adaptive hoisting mechanism of claim 8, wherein the cable tensioning mechanism comprises a cable binding reel and a cable pushing reel, wherein the cable binding reel is fixedly arranged on the bracket, and the cable pushing reel is provided with a second spring; the cable binding reel and the cable pushing reel are respectively arranged on two sides of the tensioning cables; and the second spring is a thrust spring and is arranged on the opposite sides against the corresponding tensioning cable.

10. The load-adaptive hoisting mechanism of claim 9, wherein four upright columns are symmetrically arranged on two sides of the roller; two roofs, two roof pulleys, two tensioning cables, two transmission wheels and two cable tensioning mechanisms are respectively and symmetrically arranged on two sides of the bracket; the inner side of each of the transmission wheels is coaxially provided with a small bevel gear; the lower part of the bracket is provided with a power output shaft fixedly provided with a large bevel gear in a sleeving manner, and the large bevel gear is meshed with the two small bevel gears respectively.

11. The load-adaptive hoisting mechanism of claim 8, wherein four upright columns are symmetrically arranged on two sides of the roller; two roofs, two roof pulleys, two tensioning cables, two transmission wheels and two cable tensioning mechanisms are respectively and symmetrically arranged on two sides of the bracket; the inner side of each of the transmission wheels is coaxially provided with a small bevel gear; the lower part of the bracket is provided with a power output shaft fixedly provided with a large bevel gear in a sleeving manner, and the large bevel gear is meshed with the two small bevel gears respectively.

* * * * *